US006269055B1

(12) United States Patent
Pikula et al.

(10) Patent No.: US 6,269,055 B1
(45) Date of Patent: Jul. 31, 2001

(54) RADIO-CONTROLLED CLOCK MOVEMENT

(75) Inventors: Michael A. Pikula, Franklin; Terrence J. O'Neill, Lake Geneva, both of WI (US)

(73) Assignee: Quartex, a division of Primex, Inc., Lake Geneva, WI (US)

( * ) Notice: Subject to any disclaimer, the term of this patent is extended or adjusted under 35 U.S.C. 154(b) by 0 days.

(21) Appl. No.: 09/192,896

(22) Filed: Nov. 16, 1998

(51) Int. Cl.[7] ..... G04B 19/22; G04C 11/02
(52) U.S. Cl. ..... 368/47; 368/21
(58) Field of Search ..... 360/21, 47

(56) References Cited

U.S. PATENT DOCUMENTS

| | | | | |
|---|---|---|---|---|
| 2,118,109 | | 5/1938 | Roberts et al. | 250/9 |
| 4,204,398 | | 5/1980 | Lemelson | 36/47 |
| 4,316,273 | | 2/1982 | Jetter | 368/47 |
| 4,645,357 | | 2/1987 | Allgaier et al. | 368/187 |
| 4,650,344 | | 3/1987 | Allgaier et al. | 368/47 |
| 4,860,268 | | 8/1989 | Allgaier et al. | 368/47 |
| 5,077,706 | | 12/1991 | Ganter | 368/47 |
| 5,089,814 | * | 2/1992 | DeLuca et al. | 368/21 |
| 5,144,599 | | 9/1992 | Blaich et al. | 368/10 |
| 5,231,612 | | 7/1993 | Allgaier et al. | 368/47 |
| 5,235,563 | | 8/1993 | Ganter et al. | 368/47 |
| 5,253,226 | | 10/1993 | Ganter | 368/47 |
| 5,270,993 | | 12/1993 | Besson et al. | 368/80 |
| 5,297,120 | * | 3/1994 | Yuzuki et al. | 368/47 |
| 5,329,501 | | 7/1994 | Meister et al. | 368/10 |
| 5,331,608 | | 7/1994 | Umemoto et al. | 368/10 |
| 5,349,570 | | 9/1994 | Kaiser | 368/47 |
| 5,363,348 | | 11/1994 | Damle | 368/47 |
| 5,375,018 | * | 12/1994 | Klausner et al. | 368/47 |
| 5,408,445 | | 4/1995 | Allgaier et al. | 368/47 |
| 5,422,863 | | 6/1995 | Minowa et al. | 368/47 |
| 5,430,693 | | 7/1995 | Ganter et al. | 368/47 |
| 5,444,672 | | 8/1995 | Kushita | 368/47 |
| 5,528,560 | | 6/1996 | Ogiyama | 368/47 |
| 5,671,192 | | 9/1997 | Schaffel | 368/47 |

FOREIGN PATENT DOCUMENTS

| | | | |
|---|---|---|---|
| 42 36 903 C 1 | 3/1994 | (DE) | G04C/11/02 |
| 0 204 851 | 6/1985 | (EP) | G04C/9/02 |
| 0 372 432 | 12/1989 | (EP) | G04G/7/02 |

* cited by examiner

*Primary Examiner*—Bernard Roskoski
(74) *Attorney, Agent, or Firm*—Laff, Whitesel & Saret, Ltd.

(57) ABSTRACT

A radio-controlled clock movement for use in a radio-controlled clock which is synchronized with timing information supplied by a broadcast time signal includes a sound transducer for providing an audible signal representative of the strength of the received time signal. The clock is synchronized by setting the clock hands to an initial set position, decoding timing information from the broadcast time signal, calculating the relative distance to move the clock hands to make the displayed time synchronous with the decoded timing information and moving the clock hands the calculated relative distance. The initial set position is determined based on the desired time zone. In this manner, time zones are considered when setting the clock.

16 Claims, 2 Drawing Sheets

RADIO-CONTROLLED CLOCK MOVEMENT

FIELD OF THE INVENTION

The present invention relates to radio-controlled clock movements. More particularly, the present invention relates to radio-controlled clock movements including signal reception indicators and manual set capabilities.

BACKGROUND INFORMATION

Wall clocks and the like are commercially available which provide for remote resetting or remote synchronization, in order that the time displayed at a particular location will be accurately synchronized with time signal information broadcast from a central control point. A number of systems utilized for this purpose involve the reception and processing of timing information that is constantly broadcast from government operated radio stations, such as WWVB, on a 60 kHz time signal.

There are areas in the United States where the signal strength of the time signal is relatively weak or subject to interference. Furthermore, the ferrite antennas typically used in radio-controlled clocks for receiving the time signal are directional in nature and require proper location placement and alignment. Without such proper placement and alignment, the timing information cannot be recovered from the time signal.

Because the WWVB time signals do not account for time zones, another challenge facing radio-controlled clock designers is to provide a method for setting the initial clock time that accounts for the time zone in which the clock is located. Prior art clocks include various methods of adjusting for different time zones such as including time zone switches for setting the desired time zone. Typically, these prior art clocks require optical and/or mechanical sensing of gear position to provide clock hand position information to a controller, which adjusts the clock hands to the time zone input by the clock user. However, the sensing component costs and extra assembly costs due to difficulties in aligning the clock hands with the position sensors during assembly make these prior art systems costly. In addition, slippage or misalignment of the position sensors during shipping or use can cause the clock to fail or become inaccurate.

Thus, there is a need for a method and apparatus for ensuring that a radio-controlled clock is properly receiving the broadcast time signal. There is also a need for an accurate and reliable method for setting a radio-controlled clock, which accounts for different time zones.

SUMMARY OF THE INVENTION

These needs and others are satisfied by the radio-controlled clock movement of the present invention. A radio-controlled clock movement according to the present invention is configured for use in a clock having a time indicating means for displaying time that is synchronized with timing information supplied by a broadcast time signal. The clock movement comprises a receiver for receiving the broadcast time signal, determining means for determining the strength of the received time signal and audible indication means for providing an audible signal representative of the determined strength of the received time signal.

Preferably, the audible indication means provides separate signals indicating a satisfactorily received time signal strength, saturation of the received time signal by interference and a poorly received signal strength. The audible indication means may provide the saturation and poorly received time signal strength indication signals for a longer period of time than the satisfactorily received time signal strength indication signal to allow the user to find a satisfactory location and orientation for the clock.

In a preferred embodiment, the time indicating means comprises a dial and clock hands and the clock movement further comprises a motor and a gearbox connected to the motor. The motor is configured to drive the gearbox, which in turn moves the clock hands around the dial. Alternatively, the time indicating means can be digital and may comprise a liquid crystal display device.

The clock movement also includes decoding means for decoding the timing information from the received time signal, setting means for setting the clock hands to an initial set position and a controller for controlling operation of the motor. The initial set position is determined based on the desired time zone. The controller is configured to assume the clock hands are set at a predetermined initial position. Based on this assumption, the controller calculates a relative distance to move the clock hands to make the displayed clock time synchronous with the decoded timing information. The controller then applies control signals to the motor to move the clock hands the relative distance from the initial set position.

The clock movement includes an internal clock wherein after the clock hands are moved the relative distance from the initial set position to make the displayed clock time synchronous with the decoded timing information, the internal clock supplies timing signals to the controller. The controller applies control signals to the motor to move the clock hands coincident with the internal clock timing signals. The clock movement attempts to resynchronize with the broadcast time signal every 6 hours or at other regular intervals. Preferably, the determining means, internal clock, controller and decoding means comprise a microprocessor.

A method of setting a radio-controlled clock for displaying a time in a desired time zone is also disclosed comprising the steps of setting the clock hands to an initial set position determined by the desired time zone, receiving the time signal, decoding timing information from the received time signal, calculating a relative distance to move the clock hands to make the displayed clock time synchronous with the decoded timing information and moving the clock hands the relative distance from the initial set position. It is assumed that the initial set position corresponds to an expected predetermined set position. The clock hands move the calculated relative distance at an accelerated rate.

The step of setting the clock hands to an initial set position may also comprise offsetting the clock hands a desired distance ahead of or behind the expected predetermined initial set position. The step of moving the clock hands a relative distance preserves the offset. In this manner, the clock can be synchronized a set time ahead or behind the actual time.

DETAILED DESCRIPTION OF THE PREFERRED EMBODIMENT

Figure 1A:
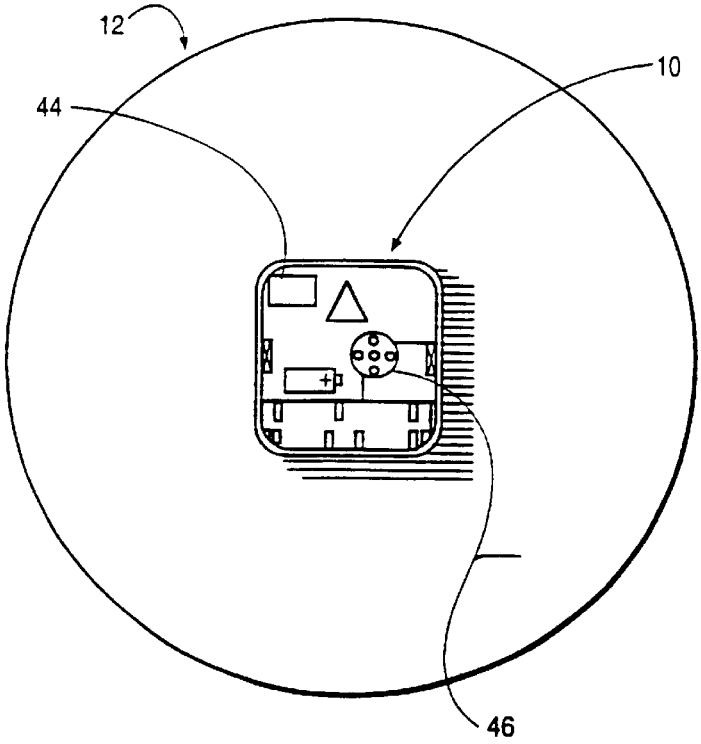
FIG. 1*a* is a rear view of a radio-controlled clock including a clock movement according to the present invention.
Figure 1B:
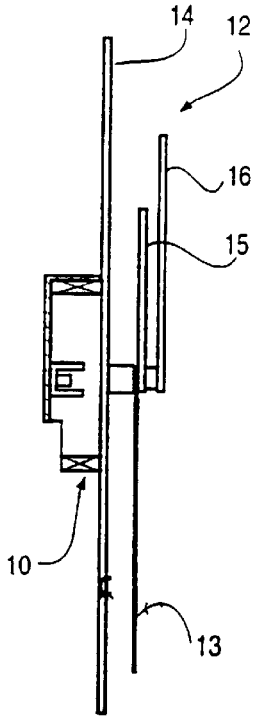
FIG. 1*b* is a side view of the clock of FIG. 1*a;*
Figure 1C:
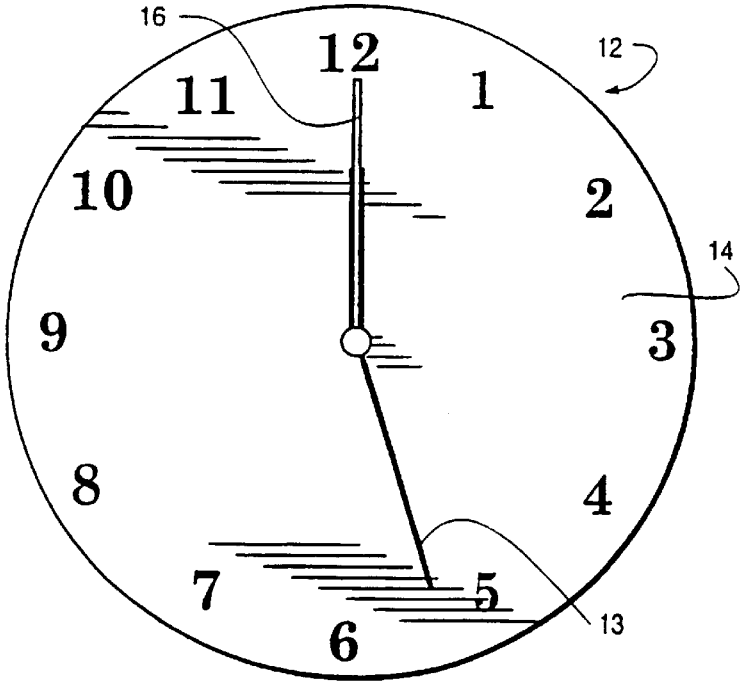
FIG. 1*c* is a front view of the clock of FIG. 1*a;*

In accordance with the present invention, a radio-controlled clock movement is described that provides distinct advantages when compared to those of the prior art. The invention can best be understood with reference to the accompanying drawing figures.

Referring now to the figures, a radio-controlled clock movement according to the present invention is generally designated by reference numeral 10. The radio-controlled clock movement 10 is powered by a power source, such as a battery, and configured for use in a radio-controlled clock 12 having a time indicating means for displaying time which is synchronized with timing information supplied by a broadcast time signal. In the preferred embodiment, the time indicating means comprises a dial 14 and clock hands, including a second hand 13, a minute hand 16, and an hour hand 15. Alternatively, the time indicating means can comprise a digital display device such as a liquid crystal display.

The clock movement 10 comprises a receiver 18, audible indication means 22, and a motor 24 all electrically connected to a controller, such as a microprocessor 20. A set button 44 for setting the second hand 13 is also electrically connected to the microprocessor 20. A gearbox 26 is connected to the motor 24 and an antenna 28 is electrically connected to the receiver 18. A set knob 46 for setting the hour and minute hands, 15 and 16 is connected to the gearbox 26.

Preferably, the antenna 28 comprises a coil of wire 19 wound around a ferrite rod 21. A tuning capacitor 23 may be electrically connected in parallel between the antenna 28 and receiver 18 for tuning the antenna 28 to the time signal frequency, which in the preferred embodiment is 60 kHz.

Figure 2:
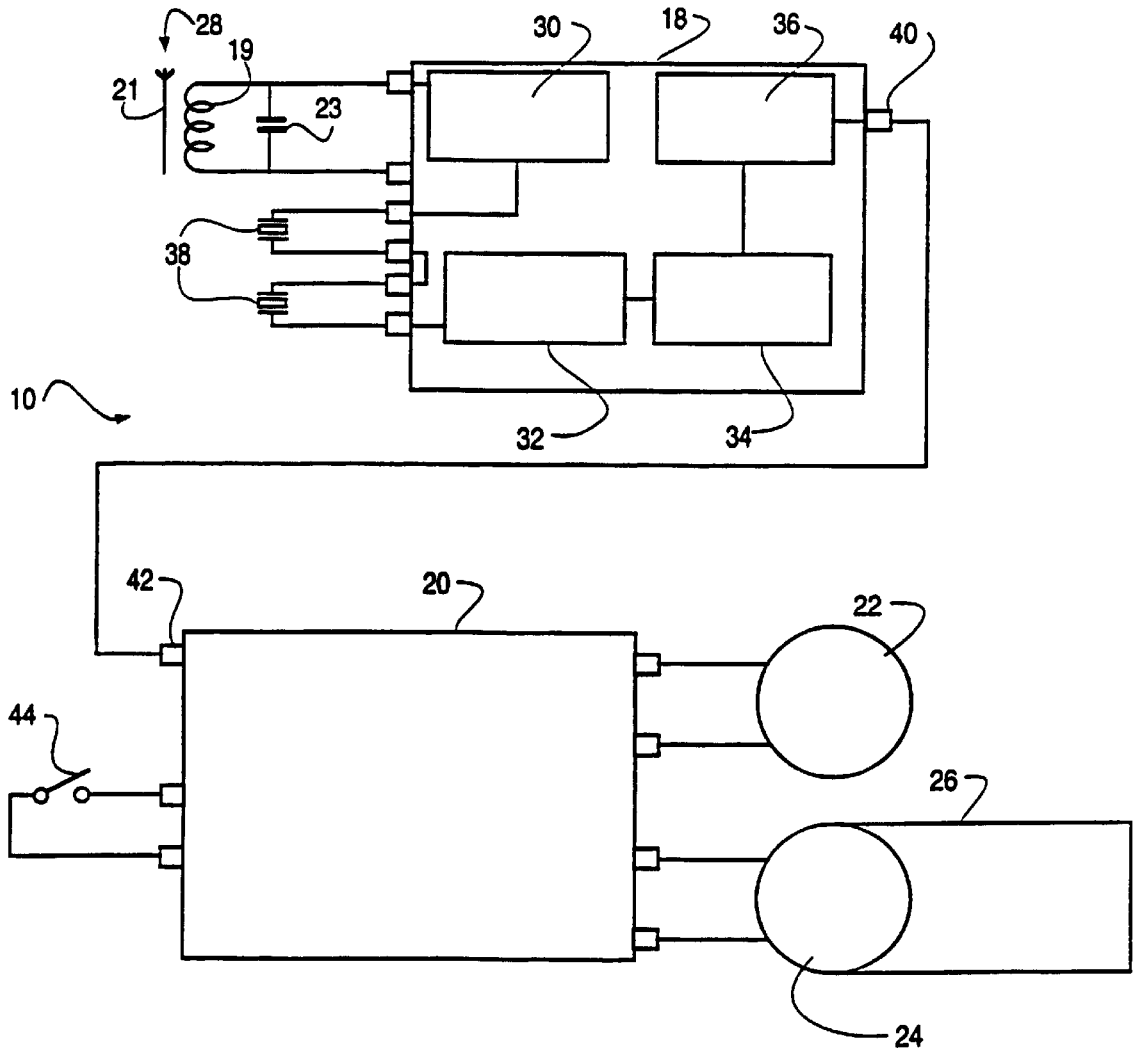
FIG. 2 is a schematic block diagram of the clock movement of FIG. 1*a.*

In the preferred embodiment shown in FIG. 2, the receiver 18 comprises a preamplifier 30, a pair of filters 38, an automatic gain control amplifier 32, a rectifier 34 and a decoder 36. The preamplifier 30 is electrically connected to the amplifier 32 through the pair of filters 38. The amplifier 32 is electrically connected to the rectifier 34. The rectifier 34 is electrically connected to the decoder 36. The output 40 of the decoder 36 acts as the output of the receiver 18 and is electrically connected to an input 42 of the microprocessor 20.

The antenna 28 and receiver 18 are configured to receive, amplify, filter and process the radio frequency broadcast time signal. The antenna 28 is configured to receive radio frequency signals and, as described above, the tuning capacitor 23 is configured to tune the antenna 28 to the frequency of the broadcast time signal. The preamplifier 30 amplifies the received radio frequency time signal so that the receiver 18 can process the signal. In the preferred embodiment, the preamplifier 30 comprises a TEMIC U4226B/T422B integrated circuit. However, similar devices may be used in place of the preamplifier specified above.

The filters 38 filter the amplified signal to eliminate noise associated with the received signal. Preferably, the filters 38 are EPSON C-2 60.00 kHz quartz filters, however other types of filters may be used in place of the above-mentioned quartz filters. In the preferred embodiment, two filters 38 are used in series. Using two filters 38 in series provides for higher selectivity in the receiver 18. However, for the purposes of this invention, any number of filters 38 can be used.

The automatic gain control amplifier 32 controls the strength of the filtered signal. Typically, the received signal strength varies as atmospheric conditions change. The automatic gain control amplifier 32 adjusts the strength of the received signal such that the signal strength in the receiver 18 remains constant in spite of variations in the received signal strength. In the preferred embodiment, the automatic gain control amplifier 32 is part of the TEMIC integrated circuit mentioned above, however similar devices may be used to control the strength of the signal in the receiver 18.

The rectifier 34 converts the received radio frequency signal into a direct current signal and the decoder 36 converts the direct current signal into a pulse width modulated logic level signal. In the preferred embodiment, the rectifier 34 and the decoder 36 also are part of the TEMIC integrated circuit mentioned above. However, similar devices may be used to convert the received time signal from a radio frequency signal into a logic level signal.

The microprocessor 20 synchronizes with the received time signal, decodes timing information from the time signal, verifies the decoded signal, compares the verified signal to the clock movement's 10 time, relays the received signal strength to the audible indication means 22 and adjusts the clock hands 13, 15 and 16 to agree with the decoded timing information. In the preferred embodiment, the microprocessor 20 comprises an EM-MARIN 6603, however similar devices may be used in place of the microprocessor 20 for accomplishing the above-identified tasks.

The audible indication means 22 is configured to provide an audible representation of the received time signal strength. Preferably, the audible indication means 22 provides distinct audible representations signaling satisfactory received time signal strength, a received time signal saturated by another source and poor received time signal strength with a high level of interference. In the preferred embodiment, the audible indication means 22 comprises a sound transducer such as a TDK MSD952001 speaker electrically connected to the microprocessor 20.

The gearbox 26 and motor 24 are configured for moving the clock hands 13, 15 and 16 so that the clock hands 13, 15 and 16 display the correct current time. Preferably, the gearbox 26 includes gear linkage for maintaining the relative positions of the clock hands 13, 15 and 16 as is commonly used in conventional mechanical clocks.

The motor 24 drives the gearbox 26 in response to signals from the microprocessor 20. The clock hands 13, 15 and 16 are connected to the gearbox 26 such that the clock hands 13, 15 and 16 move as the motor 24 drives the gearbox 26. In this manner, the clock hands 13, 15 and 16 are moved to display the current correct time. In the preferred embodiment, the motor 24 comprises a transducer circuit board assembly, permanent magnet, two pole, two position, direct current stepper motor.

It is known to those concerned with reception of the WWVB time signal that there are areas in the United States where the signal strength of the time signal is weak or subject to interference. It is also known that ferrite antennae, such as the one used in the preferred embodiment of the present invention, are directional in nature. Therefore, proper location and alignment of the receiving antenna 28 are important to ensure proper time signal reception.

The present invention includes an audible indication means 22 for providing an audible representation of the received signal strength. Upon initialization, the receiver time processed time signal to the microprocessor 20. The microprocessor 20 measures the level of the processed time signal and relays the signal strength of the processed time signal to the audible indication means 22. The audible indication means 22 sounds an immediate audible representation of the time signal strength of the signal being received.

In the preferred embodiment, the audible representation is modulated with the received time signal. A regular on/off sound at one-second intervals indicates satisfactory reception. No sound or a constant sound indicates that the signal is being received, but is being saturated by another source, such as a television monitor or microwave oven. A static or erratic sound indicates poor received signal strength and a high level of interference.

The length of time that the audible indication means 22 provides the audible representation varies with reception. For example, if the time signal reception is satisfactory, the audible representation is shut off in a short period of time. However, if the time signal reception is poor or being saturated, the audible representation remains on for a longer period of time to allow the user time to find a position or orientation that is satisfactory. The low power requirements of this type of audible indication are especially adaptable to the 1.5-volt battery power source typically used in clock movements.

In operation, the clock 12 is initially synchronized with the broadcast time signal by the microprocessor 20. When power is initially supplied to the clock 12, the receiver 18 begins receiving the broadcast time signal. The received time signal is processed by the receiver 18 and then sent to the microprocessor 20. The microprocessor 20 decodes timing information from the time signal and synchronizes the clock 12 to the timing information. After initial synchronization, the receiver 18 is put to sleep and the microprocessor's 20 internal clock takes over operation of the clock 12.

The clock movement 10 will attempt to resynchronize the clock 12 to the time signal at regular intervals, such as every 6 hours, by waking up the receiver 18 and decoding the time signal. Upon decoding of a good time signal, the microprocessor 20 automatically compares its internal clock time to the decoded timing information and adjusts the internal clock and clock hands 13, 15 and 16 to match the timing information. A quick or slow sweep of the clock hands 13, 15 and 16 will be made to adjust the clock hands 13, 15 and 16 depending on the direction of the adjustment. This resynchronization will compensate for any manufacturing tolerances present in the microprocessor's internal clock.

Automatic time correction for daylight savings time is done in a similar manner. At the appropriate time, the time signal is encoded with data bits that signal the clock movement 10 to adjust the internal clock time and clock hands 13, 15 and 16 to account for daylight savings time. In the preferred embodiment, a marker pulse signals when data bits are being sent. This adjustment is typically done at 2 A.M. Central time. Additionally, when power is cut off from the clock movement 10, such as when battery replacement is required, the time set procedure must be repeated.

The broadcast time signal of interest in the preferred embodiment is the WWVB 60 kHz signal, which is broadcast from Fort Collins, Colo. This time signal includes "coordinated universal time" information. Coordinated universal time, also known as Greenwich Mean Time, provides reference time information from which local time may be calculated. In the United States, the actual or local time has been divided into several time zones. Each time zone has its own time, which is exactly one hour ahead or behind adjacent time zones. As a result, for a radio-controlled clock in the United States that receives coordinated universal time information, some means of adjusting or compensating for the different times zones is required.

The present invention includes a method of setting a radio-controlled clock 12 which accounts for different time zones and that allows the user to set the clock 12 a predetermined measure ahead or behind the actual time. The method according to the present invention eliminates the prior art need for time zone switches and position sensing components.

The method of setting a radio-controlled clock 12 according to the present invention comprises manually setting the clock hands 13, 15 and 16 to a predetermined setting, which is different for each time zone, and then allowing the microprocessor 20 to synchronize the clock's time. This manual set feature lets the user set the clock 12 for a specific time zone and align the minute hand 16 to incorporate a time offset, such as 15 minutes fast, if desired. The clock 12 is synchronized with the time signal by the microprocessor 20 decoding timing information from the received time signal and moving the clock hands 13, 15 and 16 a relative distance from the predetermined setting position.

Time zones are accounted for by the user setting at least the hour and minute hands 15 and 16 to a particular hour setting relative to a predetermined universal coordinated time depending on the time zone the clock will be used in. The initial setting of the hour and minute hands 15 and 16 is typically done when power is disconnected from the clock movement 10. Turning the set knob 46 moves the hour and minute hands 15 and 16. Once the hour and minute hands 15 and 16 are in the desired position, power can be supplied to the clock movement 10.

If desired, the second hand 13 can then be set by depressing the set button 44. When the set button 44 is depressed, the second hand 13 sweeps around the dial 14. This movement is generally accelerated to shorten the time it takes to set the second hand 13. In the preferred embodiment, the second hand 13 sweeps 4 second positions per second. Once the second hand 13 is in the desired position, typically the 12 o'clock position, the user releases the set button 44 and the second hand 13 stops sweeping and remains in the desired position.

After a short period of inactivity by the user (the set button is left undepressed), the clock movement 10 begins receiving the time signal and providing the audible representation of the received time signal strength. After a satisfactory quality time signal has been detected, the microprocessor 20 begins decoding timing information from the time signal.

During decoding, the clock movement 10 will indicate the various stages of signal reception by the physical movement of the second hand 13. While the microprocessor 20 is decoding hour and minute information, the second hand 13 steps in 5-second increments for every 5 seconds of elapsed time. After the hour and minute information is decoded, the second hand 13 steps in 2-second increments every 2 seconds of real time while the microprocessor 20 verifies the decoded minute data. Verification occurs when two consecutive minutes have been decoded which are incrementally one minute apart.

After valid time information has been decoded, the clock movement 10 enters a high-speed sweep to bring the clock hands 13, 15 and 16 into synchronism with the decoded timing information. In high-speed sweep mode, the second hand 13 is moved 32 second positions per second. The clock movement 10 remains in high-speed mode until the clock hands 13, 15 and 16 match the current correct time as indicated by the time signal.

Once the clock hands 13, 15 and 16 have been synchronized with the correct time, the clock movement 10 enters a normal mode of clock operation with the microprocessor 20 supplying the timing information until the next time signal synchronization operation. The microprocessor 20 is configured to account for the time it takes to bring the clock hands 13, 15 and 16 in synchronism with the correct time when determining when to enter the normal mode of clock operation.

The microprocessor 20 is programmed to assume the clock hands 13, 15 and 16 are initially set at a predetermined initial position and move the clock hands 13, 15 and 16 a relative distance from the initial set position. For example, a person in the Pacific Time zone would set the clock hands 13, 15 and 16 to the 1:00 position, a person in the Mountain Time zone would set the clock hands 13, 15 and 16 to 2:00, a person in the Central Time zone would set the clock hands 13, 15 and 16 to 3:00 and a person in the Eastern Time zone would set the clock hands 13, 15 and 16 to 4:00. In this example, the microprocessor 20 is programmed to assume the clock hands 13, 15 and 16 are initially set to a position relative to 9:00 coordinated universal time. Thus, it can be seen that the user does not have to know the current time in a time zone in order to properly set the clock 12. These initial set position examples are only a sample set, any grouping of initial set positions could be used to provide the same functionality.

Upon receiving the time signal, the microprocessor 20 decodes timing information from the time signal and calculates the relative difference between the assumed initial clock hand set position and the current time indicated by the decoded timing information. Then the microprocessor 20 signals the motor 24 which drives the gearbox 26 causing the clock hands 13, 15 and 16 to move the relative difference between the initial clock hand set position and the current time.

In this manner, it is possible to set the clock 12 ahead or behind the actual time by positioning the clock hands 13, 15 and 16 ahead or behind the assumed initial set position. Because the microprocessor 20 assumes the clock hands are in the initial set position, any offset incorporated by the user will be maintained even after the clock 12 is synchronized with the time signal.

Preferably, the gearbox 26 includes a slip mechanism that maintains the relative position of the hour and minute hands 15 and 16 even if the hands 15 and 16 move such as during shipment or handling. This control of relative hand position avoids the permanent inaccuracies that hand movement can cause when an optically sensed clock hand position method, such as those in the prior art, is used. For example, if the position sensors on the hands of a prior art clock become misaligned with the clock hands, it is possible for relative alignment of the minute hand to the hour hand to be inaccurate. Because the manual set feature of the present invention does not require special hand and sensor element alignment, the clock hands 13, 15 and 16 can be installed and removed in the clock 12 without introducing permanent inaccuracies.

It will be apparent to those skilled in the art that modifications may be made without departing from the spirit and scope of the invention. Accordingly, it is not intended that the invention be limited except as may be necessary in view of the appended claims.

What is claimed is:

1. A radio-controlled clock movement for use in a radio-controlled clock having a time indicating means for displaying time in a desired time zone, the dock being synchronized with timing information supplied by a broadcast time signal including a timing signal, the clock movement comprising:

a receiver for receiving the broadcast time signal;

a microprocessor for producing an output indication of receipt of timing information, unsatisfactory receipt of timing information due to saturation of said received time signal by interference and unsatisfactory receipt of timing information due to poor received signal strength;

audible indication means for receiving the output and providing an audible representation of said timing information of said received time signal.

2. The clock movement of claim 1 wherein said audible indication means provides said audible representations of unsatisfactory receipt of timing information for a longer period of time than for satisfactory receipt of timing information.

3. The clock movement of claim 1 wherein the time indicating means comprises a dial and clock hands, said clock movement further comprising a motor and a gearbox connected to said motor which drives said gear box which in turn moves said clock hands around said dial.

4. The clock movement of claim 1 further comprising means for decoding the timing information from said received time signal.

5. The clock movement of claim 3 further comprising:

means for setting said clock hands to an initial set position;

means for decoding the timing information from the received broadcast time signal; and a controller for controlling operation of said motor;

wherein said initial set position is determined based on the desired time zone and said controller is configured to assume said clock hands are set at a predetermined initial position, calculate a relative distance to move said clock hands to make the displayed clock time synchronous with the decoded timing information and apply control signals to said motor to move said clock hands said relative distance from said initial set position.

6. The clock movement of claim 5 further comprising an internal clock wherein after said clock hands are moved said relative distance from said initial set position to make the displayed clock time synchronous with the decoded timing information, said internal clock supplies timing signals to said controller and said controller applies control signals to said motor to move said clock hands coincident with said internal clock timing signals.

7. The clock movement of claim 5 wherein said controller and said means for decoding comprise a microprocessor.

8. A method of setting a radio-controlled clock for displaying a time in a desired time zone, the clock having clock hands, a dial and means for moving the clock hands, the clock being synchronized with timing information supplied by a broadcast signal, the method comprising the steps of:

setting the clock hands to a predetermined initial set position determined based on the desired time zone;

receiving the time signal;

decoding timing information from the received time signal;

calculating a relative distance to move said clock hands to make the displayed clock time synchronous with the decoded timing information; and moving the clock hands said relative distance from said predetermined initial set position.

9. The method of claim 8 wherein said clock hands are moved said calculated relative distance at an accelerated rate.

10. The method of claim 8 wherein said step of setting the clock hands to an initial set position further comprises setting the clock hands at an offset a desired distance ahead of or behind said predetermined initial set position and said step of moving said clock hands a relative distance preserves said offset.

11. A radio-controlled clock movement for use in a radio-controlled clock having clock hands and a dial for displaying time in a desired time zone, the displayed time being synchronized with timing information supplied by a broadcast time signal, the clock movement comprising;

a receiver for receiving the broadcast time signal; decoding means for decoding the timing information from said received broadcast time signal;

moving means for moving the clock hands around the dial;

setting means for setting the clock hands to an initial set position; and calculating means for calculating a relative distance to move the clock hands to make the displayed time synchronous with said decoded timing information, wherein said initial set position is determined based on the desired time zone and said moving means is configured to assume the clock hands are set at a predetermined set position and move the clock hands said calculated relative distance from said initial set position.

12. The clock movement of claim 11 further comprising an internal clock wherein after the clock hands are moved said relative distance from said initial set position to make the displayed time synchronous with said decoded timing information, said internal clock supplies timing signals to said moving means and said moving means moves the clock hands coincident with said internal clock timing signals.

13. The clock movement of claim 12 wherein said moving means, said decoding means and said internal clock comprise a microprocessor.

14. The clock movement of claim 11 further comprising:

audible indication means for providing an audible representation of said timing information.

15. The clock movement of claim 14 wherein said audible indication means further provides separate audible representations indicating satisfactory received and unsatisfactory received timing information.

16. The clock movement of claim 15 wherein said audible indication means provides said audible representation of unsatisfactory receipt of timing information for a longer period of time than for satisfactory receipt of said timing information.

* * * * *

UNITED STATES PATENT AND TRADEMARK OFFICE

CERTIFICATE OF CORRECTION

PATENT NO. : 6,269,055 B1 
DATED : July 31, 2001
INVENTOR(S) : Michael A. Pikula et al.

It is certified that error appears in the above-identified patent and that said Letters Patent is hereby corrected as shown below:

Title page,
Item [75], Inventors, should read as follows:
-- [75] Inventors Michael A. Pikula, Franklin; Terrance J. O'Neill, Lake Geneva; Robin Gollnick, Lake Geneva, all of WI (US) --

Signed and Sealed this

Thirteenth Day of July, 2004

JON W. DUDAS
*Acting Director of the United States Patent and Trademark Office*